United States Patent [19]

Laiacona et al.

[11] Patent Number: 4,583,303

[45] Date of Patent: Apr. 22, 1986

[54] BUNION BRACE

[76] Inventors: James A. Laiacona; Frances M. Laiacona, both of 300 SW. 14 Pl., Boca Raton, Fla. 33432

[21] Appl. No.: 622,477

[22] Filed: Jun. 20, 1984

[51] Int. Cl.[4] ..... A43B 7/30

[52] U.S. Cl. ..... 36/95; 36/96; 2/24

[58] Field of Search ..... 36/95, 96, 94, 88, 89; 2/24

[56] References Cited

U.S. PATENT DOCUMENTS

| | | | |
|---|---|---|---|
| 1,175,718 | 3/1916 | Crowe | 36/95 |
| 1,819,766 | 8/1931 | Capezio | 36/96 |
| 2,261,041 | 10/1941 | Tennant | 36/96 |
| 3,937,218 | 2/1976 | Gaylord | 2/24 |
| 4,038,762 | 8/1977 | Swan | 36/89 |
| 4,128,951 | 12/1978 | Tansill | 36/88 |
| 4,227,320 | 10/1980 | Borgeas | 36/88 |
| 4,354,280 | 10/1982 | Hayes | 2/24 |
| 4,463,761 | 8/1984 | Pals et al. | 36/88 |

*Primary Examiner*—Werner H. Schroeder
*Assistant Examiner*—Mary A. Ellis

[57] ABSTRACT

This invention is a pad for wearing inside a shoe, and positioning against a bunion; the pad being contoured on one side to fit the bunion, and contoured on its other side to fit the shoe.

3 Claims, 8 Drawing Figures

BUNION BRACE

This invention relates generally to orthopedic devices. More specifically, it relates to foot pads.

It is well known to those persons who are afflicted with bunions on their feet, that this malady not only is painful when trying to accommodate the deformed foot inside a shoe, but it additionally makes an unsightly appearance by forming protruding bulges on the shoe. This situation is, accordingly, in need of an improvement.

Therefore, it is a principal object of the present invention to provide an orthopedic device that fits inside a shoe, so as to serve as a pad between a bunion and the shoe, and which is made to contour to the specific individual bunion, so that the bunion is cushioned comfortably from any pressure area of the shoe, and which additionally is contoured on its outer side, in order to fit the normal contoured shape of the shoe, so that it looks natural and does not reveal the presence of a bunion, thus preventing an inferiority complex by the person.

Another object is to provide a bunion brace, which will particularly aid those sufferers who cannot afford surgery.

Other objects are to provide a bunion brace, which is simple in design, inexpensive to manufacture, rugged in construction, easy to use, and efficient in operation.

These, and other objects, will be readily evident, upon a study of the following specification, and the accompanying drawing, wherein.

Figure 1:
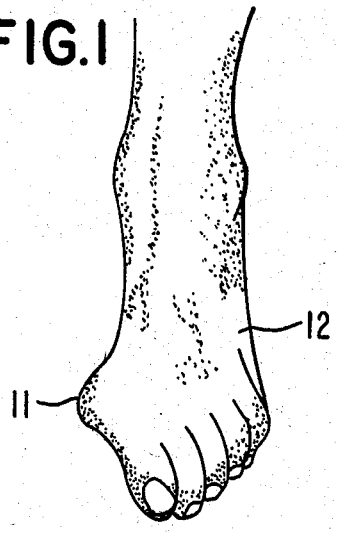
FIG. 1 is a downwardly inclined front elevational view of a person's foot, having a bunion.
Figure 2:
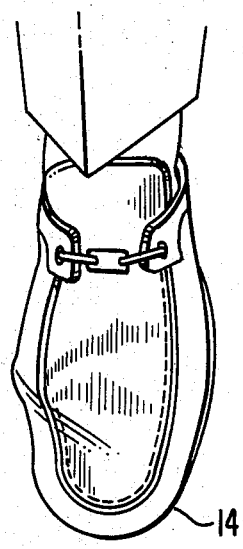
FIG. 2 is a similarly taken view of a conventional shoe, shown installed on the bunioned foot of FIG. 1.
Figure 3:
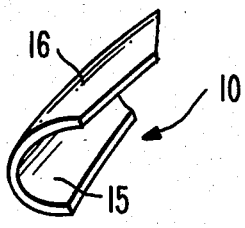
FIG. 3 is a perspective view of the invention.
Figure 4:
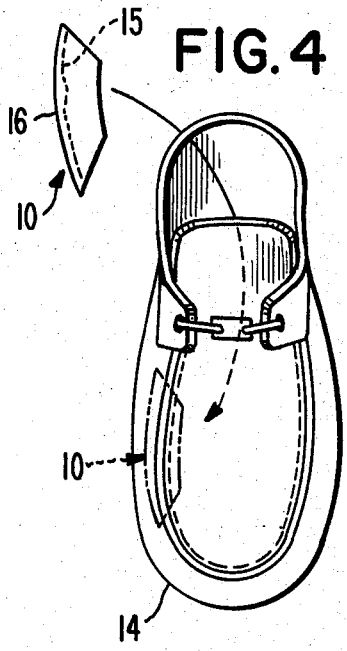
FIG. 4 is a downwardly inclined front elevational view of the shoe shown in FIG. 2, and showing how the present invention is installed therewithin.
Figure 5:
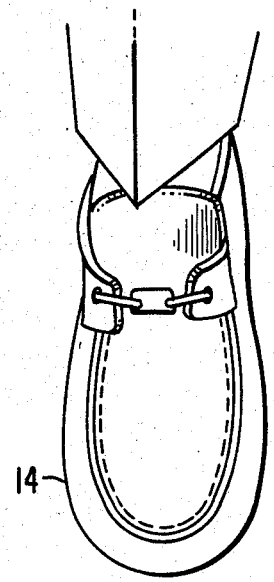
FIG. 5 is a similar view thereof, shown after it is fitted on a bunioned foot.
Figure 6:
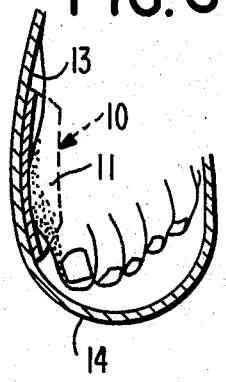
FIG. 6 is a fragmentary cross-sectional view thereof.
Figure 7:
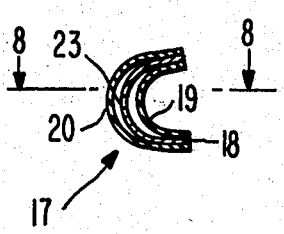
Figure 8:
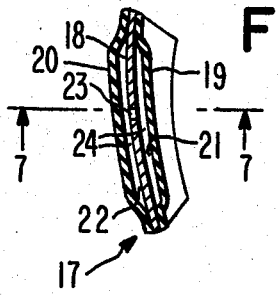

FIG. 7 is a cross-sectional view, taken on line 7—7 of FIG. 8, and showing a modified design of the invention, which additionally includes a pad on each side of the plate for more smooth and rounded fitting against the shoe and the bunion, and FIG. 8 is a cross-sectional view on line 8—8 of FIG. 7, and showing the pads being made of resilient material forming a sealed hollow chamber on each side of the plate that interconnect by a small hole therebetween.

Referring now to the drawing in greater detail, and more particularly to FIGS. 1 to 6 thereof, at this time, the reference numeral 10 represents a bunion brace, according to the present invention, for placement between a bunion 11 of a person's foot 12 and an inner surface 13 of a shoe 14. The device is molded and shaped specifically to the existing bunion, and is of appropriate size, as needed. The surface 15 contacting the bunion is of comfortably soft material, and the surface 16, contacting the shoe surface, is of rigid material in order to conform to the shoe shape, so that the device may be molded of suitable plastics.

In use, the brace is simply fitted into the shoe when the foot is inserted therein.

Referring now to FIGS. 7 and 8, a modified design of bunion brace 17 is shown to be made of a generally contoured central plate 18, made of a rigid plastic, a flexible soft plastic wall 19 and a flexible semi-soft plastic wall 20 on opposite sides of the plate. The walls are heat-sealed, all along their edges, to the peripheral edge of the plate, so that sealed chambers 21 and 22 are formed on opposite sides of the plate; the chambers being in communication with each other by means of one or more small bleed holes 23 through the plate, so as to permit movement therebetween of either a fluid or air 24 that is sealed therein. In this design, each side wall and its sealed chamber thus forms a pad, that is self adjustable in contour and size, so as to fit both the bunion and shoe, as ideally needed. Such self adjustment may occur at each foot step, while walking, so as to be more comfortable for longer periods of time.

While various changes may be made in the detail construction, it is understood that such changes will be within the spirit and scope of the present invention, as is defined by the appended claims.

What we claim as new, is:

1. A bunion brace, comprising, in combination, a pad assembly for placement inside a shoe, and located between a wearer's bunion and an inner surface of said shoe, and said assembly having self-controlled means for automatically individually adjusting a contour of its one side to fit against said bunion and a contour of its other side to fit against said shoe surface; said means comprising a rigid plastic central plate of a size that is suitable for said bunion, a flexible soft wall adjacent one side of said central plate and a flexible semi-soft plastic wall adjacent an opposite side of said central plate, both said walls being heat-sealed along their edges to a peripheral edge of said plate, a sealed chamber being formed between each said plate side and each said wall, a bleed hole through said central plate for communication of said chambers with each other and a free-flowing vehicle in said chambers for movement through said bleed hole.

2. The combination as set forth in claim 1, wherein said vehicle is fluid.

3. The combination as set forth in claim 1, wherein said vehicle is air.

* * * * *